US009803429B2

(12) United States Patent
Rodriguez et al.

(10) Patent No.: US 9,803,429 B2
(45) Date of Patent: Oct. 31, 2017

(54) EXTENDABLE CONNECTION OF ELECTRONIC COMPONENTS

(71) Applicant: Schlumberger Technology Corporation, Sugar Land, TX (US)

(72) Inventors: Rafael Rodriguez, Sugar Land, TX (US); Nicholas Smith, Katy, TX (US); Mohamed Ali Hussein, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 727 days.

(21) Appl. No.: 14/249,184

(22) Filed: Apr. 9, 2014

(65) Prior Publication Data

US 2015/0292286 A1 Oct. 15, 2015

(51) Int. Cl.
*E21B 17/02* (2006.01)

(52) U.S. Cl.
CPC ..... *E21B 17/028* (2013.01)

(58) Field of Classification Search
CPC .... E21B 17/028; E21B 17/023; E21B 17/025; E21B 17/003; E21B 23/14
USPC ..... 166/66.7; 439/277
See application file for complete search history.

(56) References Cited

U.S. PATENT DOCUMENTS

| | | | | |
|---|---|---|---|---|
| 3,957,118 | A * | 5/1976 | Barry | E21B 23/14 166/385 |
| 4,660,910 | A * | 4/1987 | Sharp | E21B 17/028 439/194 |
| 5,058,683 | A * | 10/1991 | Godfrey | E21B 17/028 166/381 |
| 5,433,276 | A | 7/1995 | Martain et al. | |
| 5,947,198 | A * | 9/1999 | McKee | E21B 17/023 166/377 |
| 6,902,414 | B2 * | 6/2005 | Dopf | E21B 17/028 439/140 |
| 2002/0193004 | A1 | 12/2002 | Boyle et al. | |
| 2005/0016769 | A1 | 1/2005 | Wallace | |
| 2006/0225926 | A1 | 10/2006 | Madhavan et al. | |
| 2010/0300698 | A1 | 12/2010 | Bedouet et al. | |

OTHER PUBLICATIONS

International Search Report for corresponding International App No. PCT/US2015/024846, Jul. 21, 2015, 3 pages.
Written Opinion for corresponding International App No. PCT/US2015/024846, Jul. 21, 2015, 11 pages.

* cited by examiner

*Primary Examiner* — Michael Wills, III

(57) ABSTRACT

The present disclosure introduces methods and apparatus for connecting first and second downhole components. A first interface of a first subassembly is coupled to a first component. The first subassembly includes a first connector. A second interface of a second subassembly is coupled to a second component. The second subassembly includes a body and a second connector extendable from the body. The second connector remains communicably connected to the second interface by a conductor extendable from and retractable into the body, including when the second connector is extended away from the body and coupled to the first connector.

16 Claims, 8 Drawing Sheets

EXTENDABLE CONNECTION OF ELECTRONIC COMPONENTS

BACKGROUND OF THE DISCLOSURE

Tool strings utilized downhole in the oil and gas industry include multiple tools, modules, and/or other components that are assembled end-to-end, many times at the wellsite, perhaps even on the rig floor. However, when making up adjacent components of a tool string, connecting the electronics of the adjacent components is often a "blind" operation because the electrical connectors are contained within the tool string components, such as to isolate the electronics and electrical connectors from the rigors of the wellbore. Making the blind connections—also referred to as "stabbing"—is a common cause of equipment failure at the wellsite.

Such issues may be exacerbated when variously sized and configured extenders are utilized to connect the tool string components. Consequently, the wellsite or field operations often keep large and expensive inventories of extenders, such as to account for manufacturing tolerances between different units of the various tool string components that may be utilized during operations at the wellsite.

SUMMARY OF THE DISCLOSURE

The present disclosure introduces an apparatus in which a first interface and a first connector are disposed at opposing ends of a first body. The first interface is operable to detachably couple with a first downhole tool conveyable within a wellbore extending into a subterranean formation. A first conductor extends between the first interface and the first connector within the first body. A second interface and a second connector are disposed at opposing ends of a second body. The second interface is operable to detachably couple with a second downhole tool. A second conductor is retractable into the second body and extends between the second interface and the second connector. The second connector is operable to extend away from the second body and detachably couple with the first connector.

The present disclosure also introduces an apparatus in which a first interface is operable to mechanically and communicably couple with a first downhole electronic component. A first connector is communicably connected to the first interface. A second interface extending from a body is operable to mechanically and communicably couple with a second downhole electronic component. The apparatus also includes a second connector and a conductor extending within the body and communicably connecting the second interface with the second connector. The second connector is extendable away from the body to mechanically and communicably couple with the first connector. The conductor extends from and retracts into the body in response to relative axial movement of the second connector and the body. A biasing member urges the second connector towards a retracted position adjacent the body.

The present disclosure also introduces a method in which a first interface of a first subassembly is coupled to a first component. The first subassembly includes a first connector. A second interface of a second subassembly is coupled to a second component. The second subassembly includes a body and a second connector extendable from the body. The second connector remains communicably connected to the second interface by a conductor extendable from and retractable into the body. The second connector is extended away from the body and then the first and second connectors are coupled together.

Additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
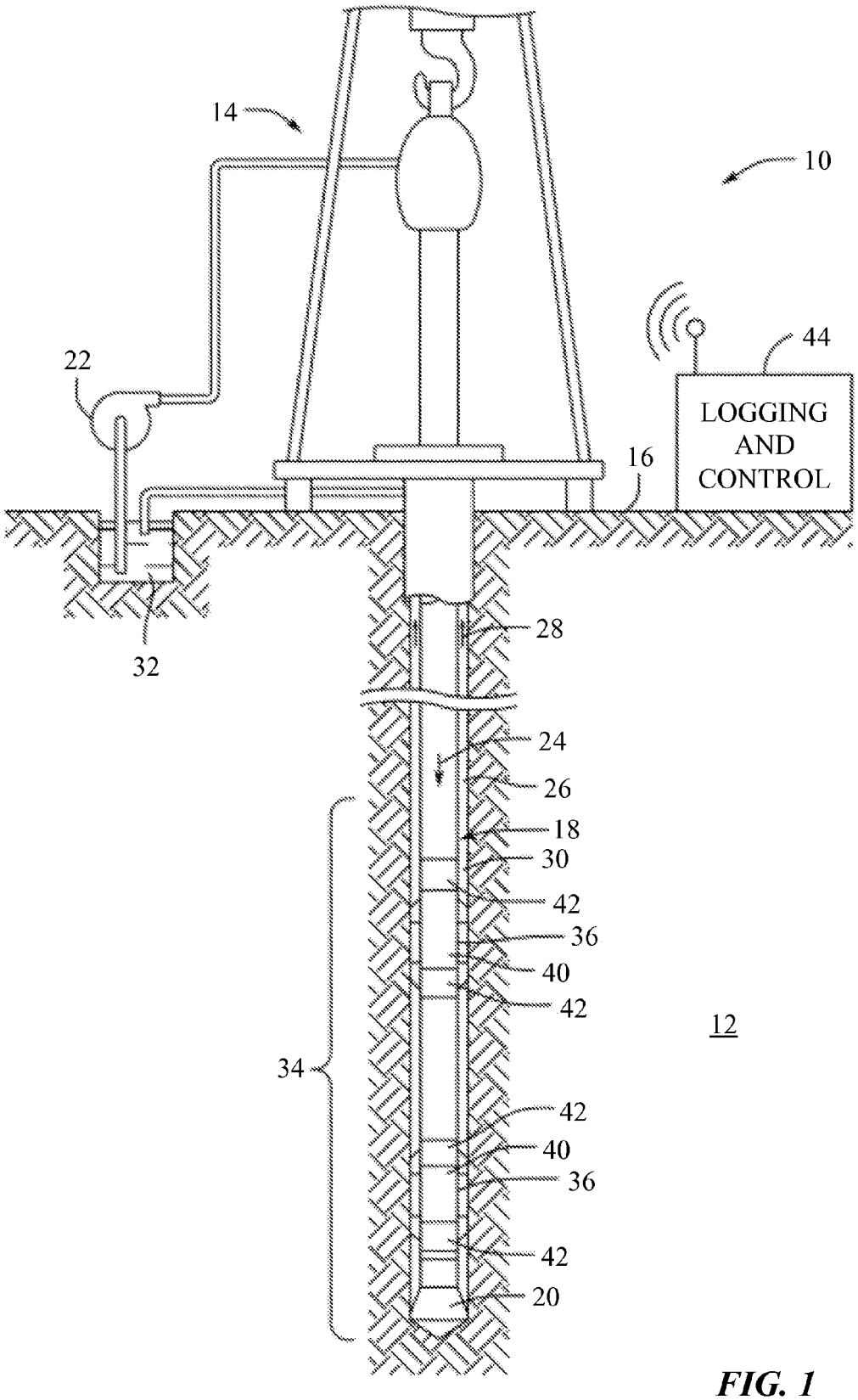
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of a drilling system 10 according to one or more aspects of the present disclosure. The drilling system 10 is operable to drill a wellbore 26 through one or more subsurface formations 12. A drilling rig 14 at the wellsite surface 16 is operable to rotate a drill string 18 that includes a drill bit 20 at its lower end. As the drill bit 20 is rotated, a pump 22 pumps drilling fluid (commonly referred to as "mud" or "drilling mud") downward through the center of the drill string 18 in the direction of arrow 24 to the drill bit 20. The mud, which is utilized to cool and lubricate the drill bit 20, exits the drill string 18 through ports (not shown) in the drill bit 20. The mud then carries drill cuttings away from the bottom of the wellbore 26 as it flows back to the wellsite surface 16 through an annulus 30 between the drill string 18 and the formation 12, as shown in FIG. 1 by arrows 28. At the wellsite surface 16, the return mud is filtered and conveyed back to a mud pit 32 for reuse.

While a drill string 18 is illustrated in FIG. 1, it will be understood that the embodiments described herein may be applicable or readily adaptable to work strings and wireline tools as well. Work strings may include a length of tubing (e.g., coiled tubing) lowered into the wellbore 26 for conveying well treatments or well servicing equipment. Wireline tools may include formation testing tools suspended from a multi-conductor cable as the cable is lowered into the wellbore 26, such as to measure formation properties at one or more depths.

The location and environment of the drilling system 10 may also vary widely depending on the formation 12 penetrated by the wellbore 26. Instead of being a surface operation, for example, the wellbore 26 may be formed under water of varying depths, such as on an ocean bottom surface. Certain components of the drilling system 10 may be adapted for underwater wells in such instances.

The lower end of the drill string 18 includes a bottom-hole assembly (BHA) 34, which includes the drill bit 20 and multiple drill collars 36. The drill collars 36 may include various instruments, such as various while-drilling modules, tools, and/or other components that include sensors, telemetry equipment, and other electronic apparatus. For example, the drill collars 36 may include logging-while-drilling (LWD) modules, tools, and/or other components 40 and/or measurement-while drilling (MWD) modules, tools, and/or other components 42. The LWD components 40 may be operable to measure formation properties and/or other parameters, such as resistivity, porosity, permeability, sonic velocity, and/or others. The LWD components 40 may also be operable to collect a solid, liquid, and/or gaseous sample from the one or more formations 12. The MWD components 42 may be operable to measure trajectory, temperature, pressure, and/or other parameters of or associated with the wellbore 26. The LWD components 40 and MWD components 42 may each be housed in one of the drill collars 36. The LWD components 40 and/or MWD components 42 may also include capabilities for measuring, processing, and/or storing information, as well as for communicating with other components of the BHA 34 and/or directly with surface equipment such as, for example, a logging and control unit 44. That is, one or more of the LWD components 40 and/or MWD components 42 may be communicatively coupled to the logging and control unit 44 disposed at the wellsite surface 16. In other implementations, portions of the logging and control unit 44 may be integrated with one or more of the LWD components 40 and/or MWD components 42.

Figure 2:
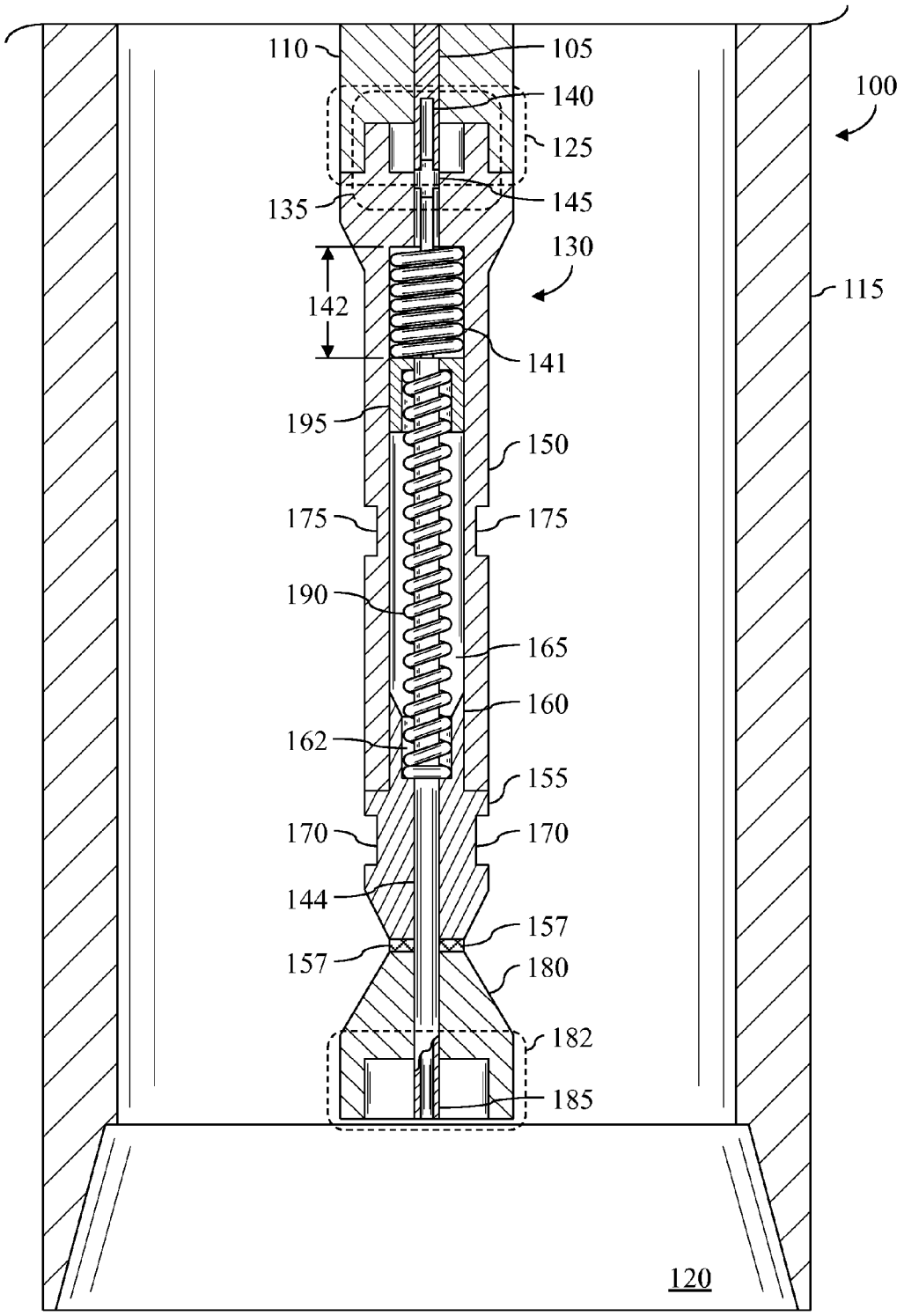
FIG. 2 is a sectional view of a portion of the apparatus shown in FIG. 1.

FIG. 2 is a sectional view of an end portion of an electronic component 100 according to one or more aspects of the present disclosure. The electronic component 100 is, comprises, or forms a portion of one of the above-described components of the BHA 34, and thus includes one or more electrical sockets and/or other electrical connectors 105 for communicably coupling with one or more corresponding electrical connectors extending from another electronic connector to which the electronic component 100 will be coupled (shown in FIG. 4). The electrical connector 105 may be at least partially embedded in or otherwise carried by an inner member 110, such as a mandrel and/or other feature of the electronic component 100. The inner member 110 is carried within a drill collar, joint, and/or other tubular 115 having an interface 120 operable to couple with an adjoining component of the BHA 34. The inner member 110 also includes an interface 125 operable to couple with an extendable connection device 130.

The extendable connection device 130 includes an interface 135 operable to couple with the interface 125 of the inner member 110, including to thereby communicably couple one or more electrical pins, connectors, and/or other conductors 140 with corresponding ones of the electrical connectors 105. For example, in the non-limiting example depicted in FIG. 2, the extendable connection device 130 includes one conductor 140 in the form of an electrical pin, and the electronic component 100 comprises one electrical connector 105 in the form of an electrical socket that receives the electrical pin when the interfaces 125 and 135 are coupled together. The interfaces 125 and 135 may be or comprise threaded, quick-connect, and/or other detachable interface means, including those that form a seal when connected, such as to isolate the electrical connection therein from mud and/or other fluids flowing within the tubular 115. The extendable connection device 130 may also comprise one or more fittings, grommets, and/or other sealing members 145 that may further ensure that internal electrical features are fluidly isolated from fluids flowing within the tubular 115.

The extendable connection device 130 may also comprise an elongated body 150. The interface 135 may be coupled to or formed integral with the body 150. The body 150 may also include an end fitting 155. The end fitting 155 may be integrally formed with or coupled to the body 150. For example, in implementations in which the end fitting 155 is a separate, discrete member of the body 150, the end fitting 155 may include an insert 160 extending into a central passage 165 of the body 150. The insert 160 may be coupled to the body 150 by press fit, interference fit, friction fit, swaging, welding, and/or other means. The insert 160 may also be threadedly coupled to the central passage 165. Thus, the end fitting 155 may include wrench flats 170 to aid in assembly to the body 150. The body 150 may similarly include wrench flats 175 to aid in such assembly. The wrench flats 175 may also aid in assembling the extendable connection device 130 to the inner member 110 of the electronic component 100, such as in implementations in which the interfaces 125 and 135 are threaded interfaces.

The extendable connection device 130 also comprises a connector 180 disposed at an opposite end of the body 150 relative to the interface 135. The connector 180 includes one or more electrical sockets and/or other electrical connectors 185 for communicably coupling with one or more corresponding electrical connectors extending from another electronic component (shown in FIG. 4) to which the electronic component 100 will be coupled via the extendable connection device 130 and the interface 120. An interface 182 of the connector 180 may be substantially similar to the interface 125 of the inner member 110. The one or more electrical connectors 185 are in electrical communication with corresponding ones of the one or more conductors 140 of the interface 135.

For example, in the example implementation shown in FIG. 2, the conductor 140 extends from the interface 135 (perhaps including through the one or more sealing members 145), into the central passage 165 of the body 150, and then through the end fitting 155 before terminating at or in the connector 180. Such termination may be via crimping, adhesive, and/or other means. A portion 141 of the conductor 140 may be coiled within the central passage 165 of the body 150, and may thus have an extendable length 142.

At least a portion of the conductor 140 may also be armored. For example, in the example implementation shown in FIG. 2, a portion of the conductor 140 is disposed within an armored sheath 144. The armored sheath 144 may comprise a braided material formed from stainless steel wire and/or other materials. The armored sheath 144 may also or instead comprise a convoluted or otherwise shaped liner (not shown) formed of PTFE (polytetrafluoroethylene) and/or other materials. The outer surface of the armored sheath 144 may also be coated with an anti-friction material (not shown), such as to ease translation relative to the end fitting 155 and/or other components of the extendable connection device 130.

The extendable connection device 130 may also include a spring and/or other biasing member 190 operable to urge the connector 180 towards the position shown in FIG. 2. For example, one end of the biasing member 190 may seat against and/or be received within a central aperture 162 of the insert 160. The other end of the biasing member 195 may seat against and/or be received within another end fitting 195 slidably contained within the central passage 165 of the body 150. The end fitting 195 may also serve as a transition between the coiled portion 141 of the conductor 140 and the portion of the conductor 140 surrounded by the armored sheath 144. For example, the end of the armored sheath 144, or a proximate portion of the conductor 140, may be coupled to the end fitting 195 by crimping, adhesive, and/or other means. The portion of the conductor 140 that is surrounded by the armored sheath 144 may also extend within the biasing member 190 within the central passage 165 of the body 150.

The extendable connection device 130 may also include means for detachably coupling the connector 180 to the end of the body 150 (e.g., to the end fitting 155) when the connector 180 is fully retracted into abutment with the end of the body 150. For example, as with the example implementation shown in FIG. 2, one or more magnetic members 157 may be affixed to the end fitting 155 and/or the connector 180 and operate in conjunction with the biasing member 190 to retain the connector 180 in the retracted position shown in FIG. 2. However, other arrangements are also within the scope of the present disclosure. For example, the interface between the connector 180 and the end fitting 155 may be threaded or include a latching mechanism, such as in implementations in which one of the connector 180 and the end fitting 155 includes a pin or other member that slides in a groove or slot of the other one of the connector 180/end fitting 155. Such groove or slot may have a J-shaped profile such that removing the connector 180 from the end fitting 155, and/or repositioning the connector 180 adjacent the end fitting 155, entails motion in at least two different directions, such as a series of at least one lateral motion and at least one rotational motion.

As described above and shown in FIG. 3, the connector 180 is operable to extend away from the body 150. Such extension compresses the biasing member 190 due to the conductor 140 and/or the armored sheath 144 being coupled to the end fitting 195. The extension also expands the coiled portion 141 of the conductor 140 to a length 143 that is substantially greater than the length 142 shown in FIG. 2.

Figure 3:
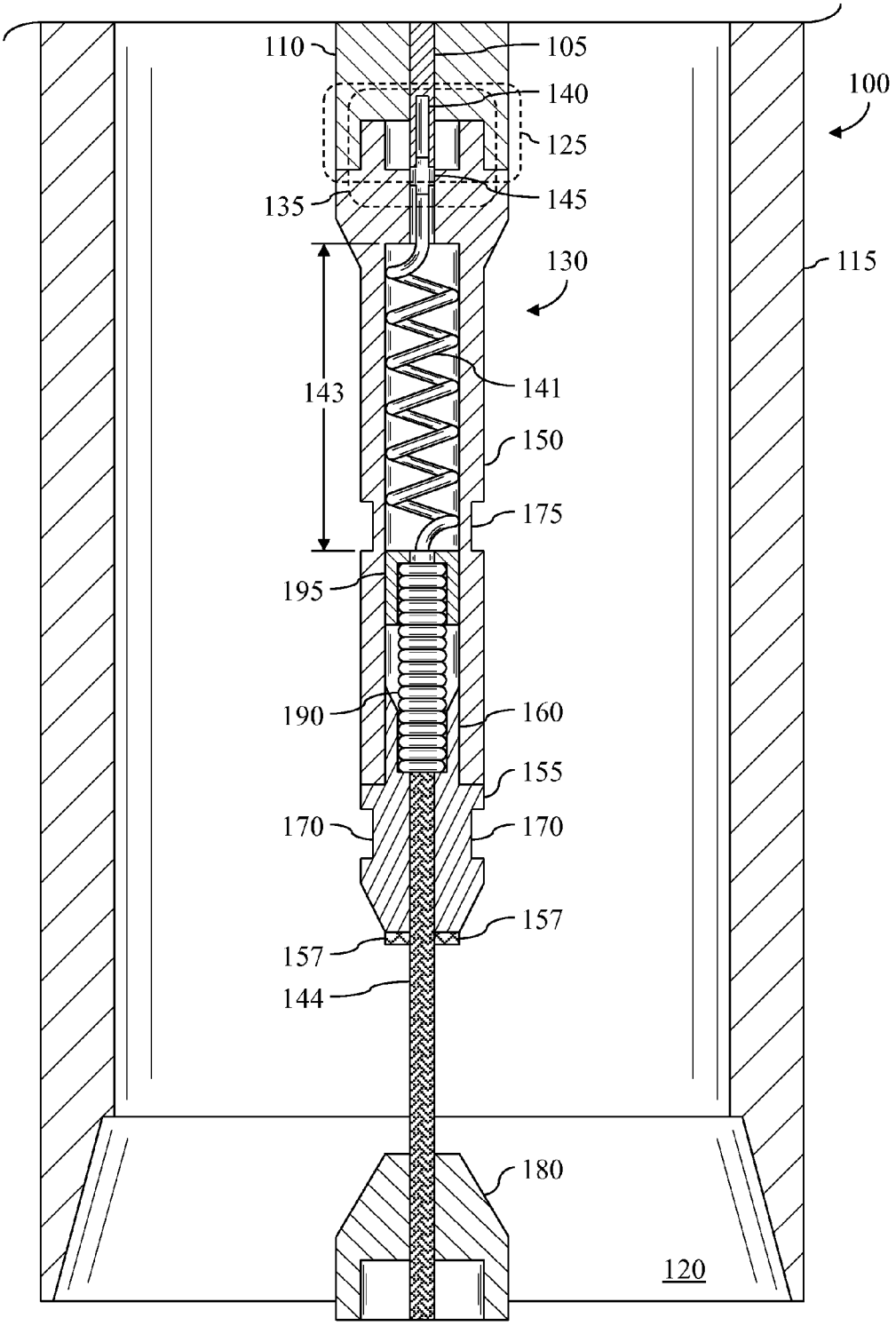
FIG. 3 is a sectional view of a portion of the apparatus shown in FIG. 1.

In the above description of FIGS. 2 and 3, the conductor 140 may comprise multiple discrete conductive elements. However, where such conductive elements are communicably connected in series, they may be referred to as a single conductor 140. A person having ordinary skill in the art will recognize that reference to a single conductor herein may refer to both a single conductor and multiple discrete conductive members connected in series.

Figure 4:
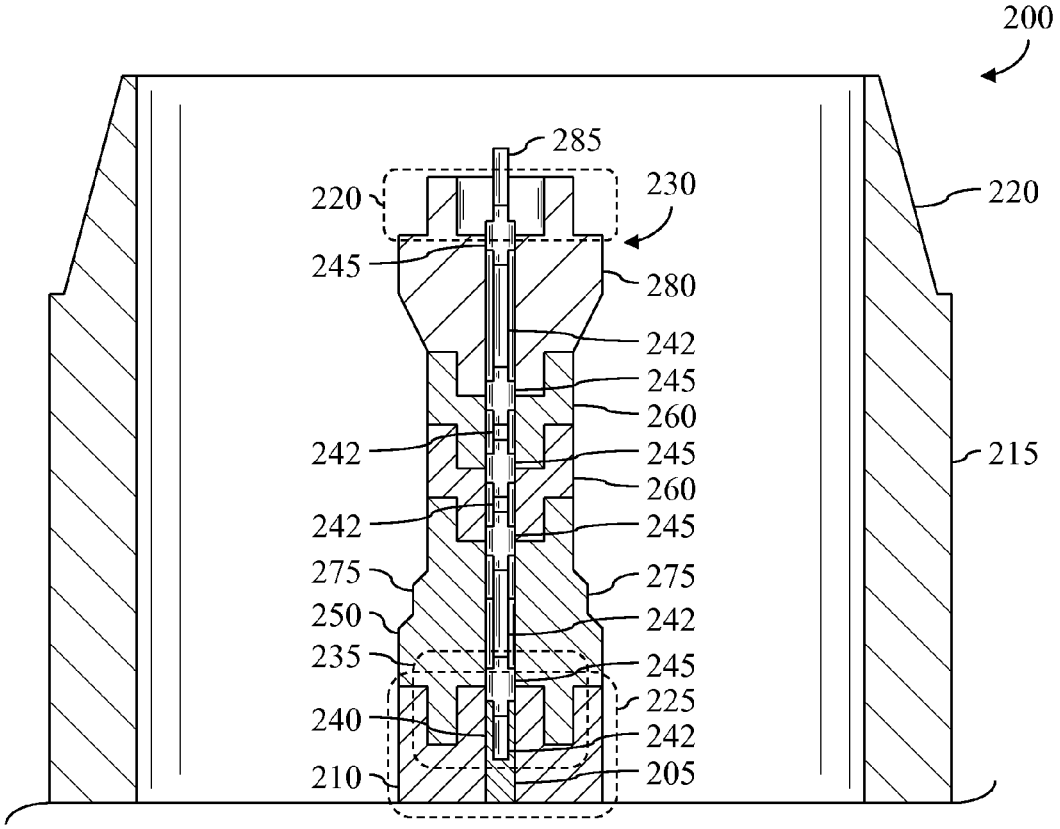
FIG. 4 is a sectional view of a portion of the apparatus shown in FIG. 1.

FIG. 4 is a sectional view of an end portion of an electronic component 200 according to one or more aspects of the present disclosure. The electronic component 200 is, comprises, or forms a portion of one of the above-described components of the BHA 34 (FIG. 1), and thus includes one or more electrical pins and/or other electrical connectors 205 for communicably coupling with, perhaps, the one or more electrical connectors 105 extending from the electronic component 100 shown in FIGS. 2 and 3 if the extendable connection device 130 shown in FIGS. 2 and 3 and the corresponding connection device 230 described below are not utilized. However, when the extendable connection device 130 shown in FIGS. 2 and 3 and the corresponding connection device 230 described below are utilized, the one or more electrical connectors 205 couple with one or more electrical pins and/or other electrical connectors 242 collectively spanning the connection device 230.

The electrical connector 205 may be at least partially embedded in or otherwise carried by an inner member 210, such as a mandrel and/or other feature of the electronic component 200. The inner member 210 is carried within a drill collar, joint, and/or other tubular 215 having an interface 220 operable to couple with the interface 120 of the electronic component 200 shown in FIG. 2. The inner member 210 also includes an interface 225 operable to couple with the connection device 230.

The connection device 230 includes an interface 235 operable to couple with the interface 225 of the inner member 210, including to thereby communicably couple one or more electrical pins, connectors, and/or other conductors 240 with corresponding ones of the electrical connectors 205. For example, in the non-limiting example depicted in FIG. 4, the connection device 230 includes one conductor 240 in the form of an electrical pin, and the electronic component 200 comprises one electrical connector 205 in the form of an electrical socket that receives the electrical pin when the interfaces 225 and 235 are coupled together. The interfaces 225 and 235 may be or comprise threaded, quick-connect, and/or other detachable interface means, including those that form a seal when connected, such as to isolate the electrical connection therein from mud and/or other fluids flowing within the tubular 215. The connection device 230 may also comprise one or more fittings, grommets, and/or other sealing members 245 that may further ensure that internal electrical features are fluidly isolated from fluids flowing within the tubular 215.

The connection device 230 may also comprise a body 250, in which case the interface 235 may be coupled to or formed integral with the body 250. The body 250 may include wrench flats 275 to aid in assembly. The body 250 may also comprise one or more spacers 260. For example, in the example depicted in FIG. 4, the body 250 includes two such spacers 260. However, the number of spacers 260 may vary depending on the actual implementation, as described further below.

The connection device 230 also comprises a connector 280 disposed at an opposite end of the body 250 relative to the interface 235. The connector 280 includes one or more electrical pins and/or other electrical connectors 285 for communicably coupling with one or more corresponding electrical connectors 185 of the connector 180 of the electronic component 100 shown in FIGS. 2 and 3. An interface 282 of the connector 280 may be substantially similar to the interface 135 of the expandable connection device 130 shown in FIGS. 2 and 3. The one or more electrical connectors 285 are in electrical communication with corresponding ones of the one or more conductors 240 of the interface 235.

For example, in the example implementation shown in FIG. 4, the conductor 240 extends from the interface 235 (perhaps including through one or more sealing members 245) through the body 250 and the one or more spacers 260 before terminating at or in the connector 280. Such termination may be via crimping, adhesive, and/or other means. One or more of the interfaces between the body 250, the spacers 260, and the connector 280 may also include one or more sealing members 245.

In the above description of FIG. 4, the discrete conductive elements depicted as the conductor 240, the electrical connectors 242, and the connector 285 may be referred to as a single conductor. As described above, a person having ordinary skill in the art will recognize that reference to a single conductor herein may refer to both a single conductor and multiple discrete conductive members connected in series.

As described above, the body 250 of the connection device 230 may include one or more spacers 260 disposed between the interface 235 and the connector 280. The one or more spacers 260 may be utilized to set a predetermined axial separation between the interface 235 and the connector 280, such as to account for manufacturing tolerances and other variations among different units of a designed component. Accordingly, electrical connections made-up between different components of a tool string at the wellsite may utilize various combinations of tool string components of different serial numbers and, thus, different actual dimensions, which may thereby provide greater flexibility when mating such tool string components in the field.

For example, the BHA 34 shown in FIG. 1 may include the electronic component 100 shown in FIGS. 2 and 3 mated with the electronic component 200 shown in FIG. 4. Previously, such mating was limited to combinations of certain serial numbers of sufficiently similar actual dimensions. That is, an instance of the electronic component 100 having serial number A may have been limited to pairing with an instance of the electronic component 200 having serial number X, whereas an instance of the electronic component 100 having serial number B may have been limited to pairing with an instance of the electronic component 200 having serial number Y. Due to actual dimensions that vary among different units of the same model number, for example, the electronic component 100 of serial number A may not be pairable with the electronic component 200 having serial number Y, and the electronic component 100 of serial number B may not be pairable with the electronic component 200 having serial number X. However, an inventory of the less expensive spacers 260 (relative to conventional extenders) of varying axial length may be kept at the wellsite and/or field office and utilized in varying combinations to permit the electronic component 100 to be paired with the electronic component 200 without regard for specific instances/serial numbers.

Each spacer 260 is threadedly or otherwise coupled between opposing components of the connection device 230, whether such components include the connector 280, the body 250 (which may be integral with the interface 235), and/or one or more other spacers 260. Each spacer 260 may also include or be assembled with one or more sealing members 245 and/or electrical connectors 242 as called for by a particular pairing of the electronic components 100 and 200, perhaps regardless of the serial numbers thereof.

Figure 5:
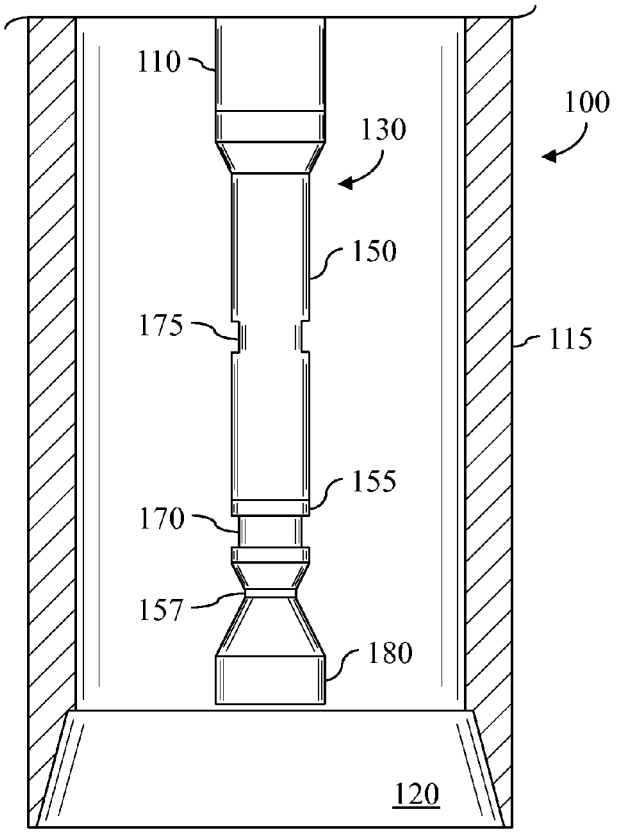
FIG. 5 is a schematic view of the apparatus shown in FIGS. 2-4.
Figure 5:
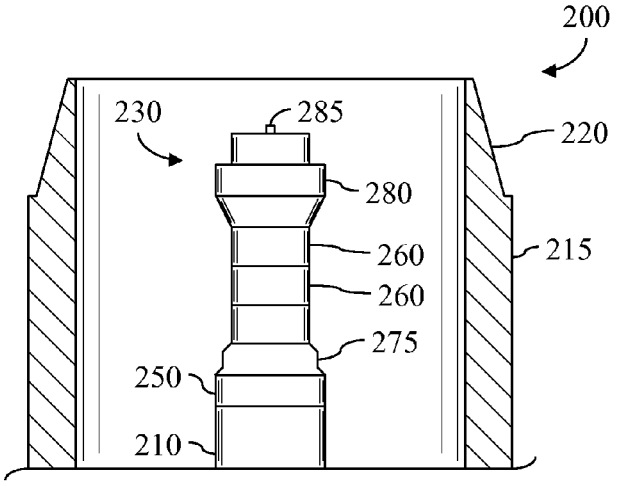

FIG. 5 is a schematic view depicting an intermediate stage of operations utilizing the electronic component 100 shown in FIGS. 2 and 3 and the electronic component 200 shown in FIG. 4. The electronic component 200 may be secured or otherwise positionally fixed at the wellsite, such as in slips (not shown) utilized during formation of the wellbore 26, among other locations at the wellsite or field office. The electronic component 100 may then be lowered or otherwise positioned in proximity with the electronic component 200, such as via operation of drawworks at the wellsite. However, a person having ordinary skill in the art will readily recognize that the relative positioning of the electronic components 100 and 200 may be reversed yet remain within the scope of the present disclosure, such that the electronic component 100 may be positionally fixed and the electronic component 200 may be lowered or otherwise positioned in proximity with the electronic component 100.

Figure 6:
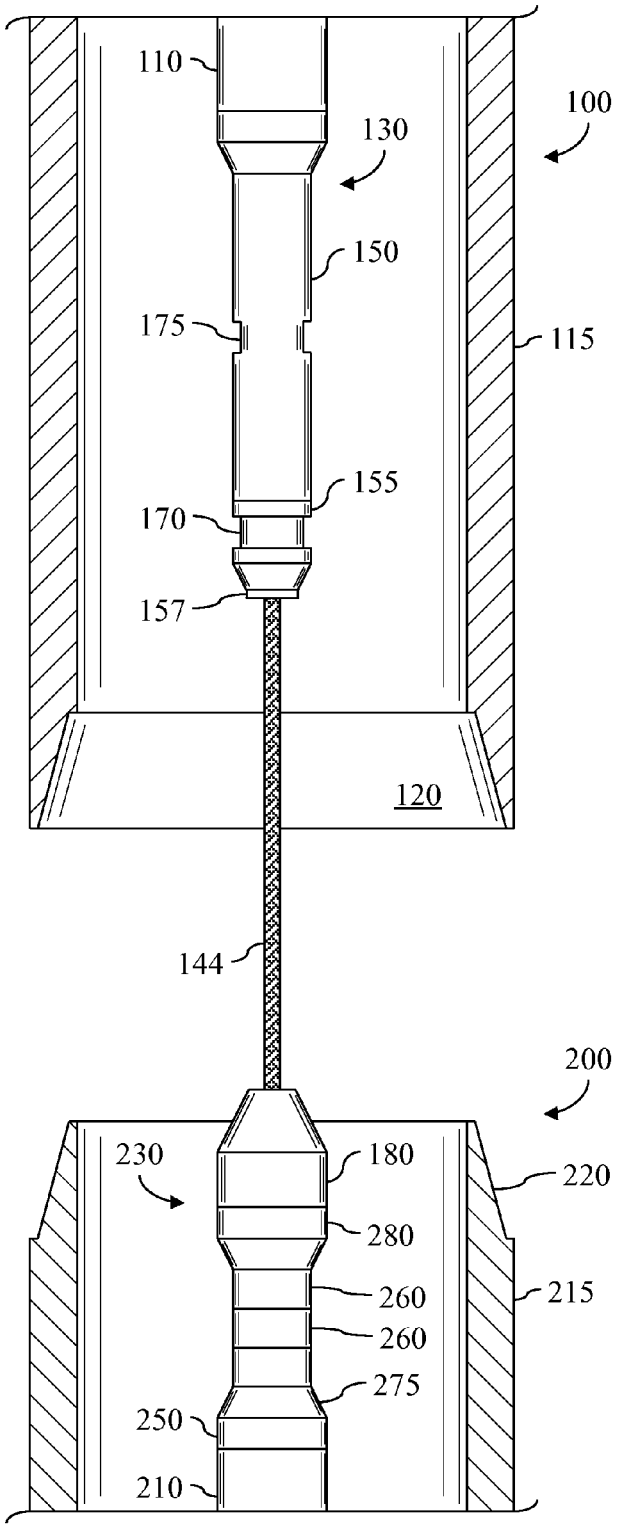
FIG. 6 is a schematic view of the apparatus shown in FIG. 5.

FIG. 6 is a schematic view of the apparatus shown in FIG. 5 in a subsequent stage of manufacture according to one or more aspects of the present disclosure, in which the connector 180 of the extendable connection device 130 has been coupled with the connector 280 of the connection device 230 by extending the connector 180 away from the body 150 of the extendable connection device 130 (e.g., via a human and/or machine operator at the wellsite). As described above with respect to FIGS. 2 and 3, such extension compresses the biasing member 190 and expands the coiled portion 141 of the conductor 140. FIG. 6 also depicts the connector 180 of the extendable connection device 130 as being communicably coupled with the connector 280 of the connection device 230, thereby establishing electronic communication between the one or more electrical connectors 105 of the electronic component 100 (shown in FIGS. 2 and 3) with the one or more electrical connectors 205 of the electronic component 200 (shown in FIG. 4). FIG. 6 also depicts that the extension of the connector 180 away from the body 150 exposes the armored sheath 144 surrounding at least a portion of the conductor 140, in implementations in which the armored sheath 144 is utilized.

Figure 7:
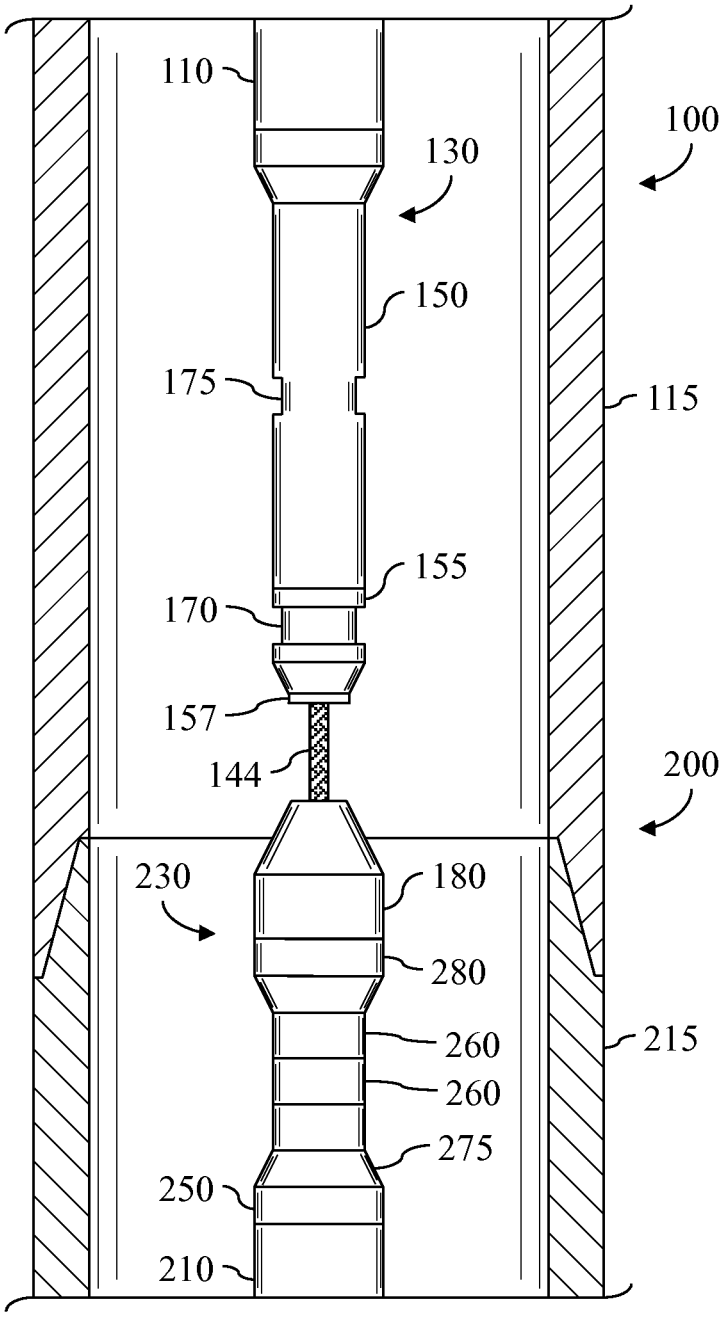
FIG. 7 is a schematic view of the apparatus shown in FIG. 5.

FIG. 7 is a schematic view of the apparatus shown in FIG. 6 in a subsequent stage of manufacture according to one or more aspects of the present disclosure, in which the electronic components 100 and 200 have been axially moved towards each other and their interfaces 120 and 220 have been coupled. Simultaneously, the conductor 140 (and the armored sheath 144, if utilized) has retracted towards the body 150.

Figure 8:
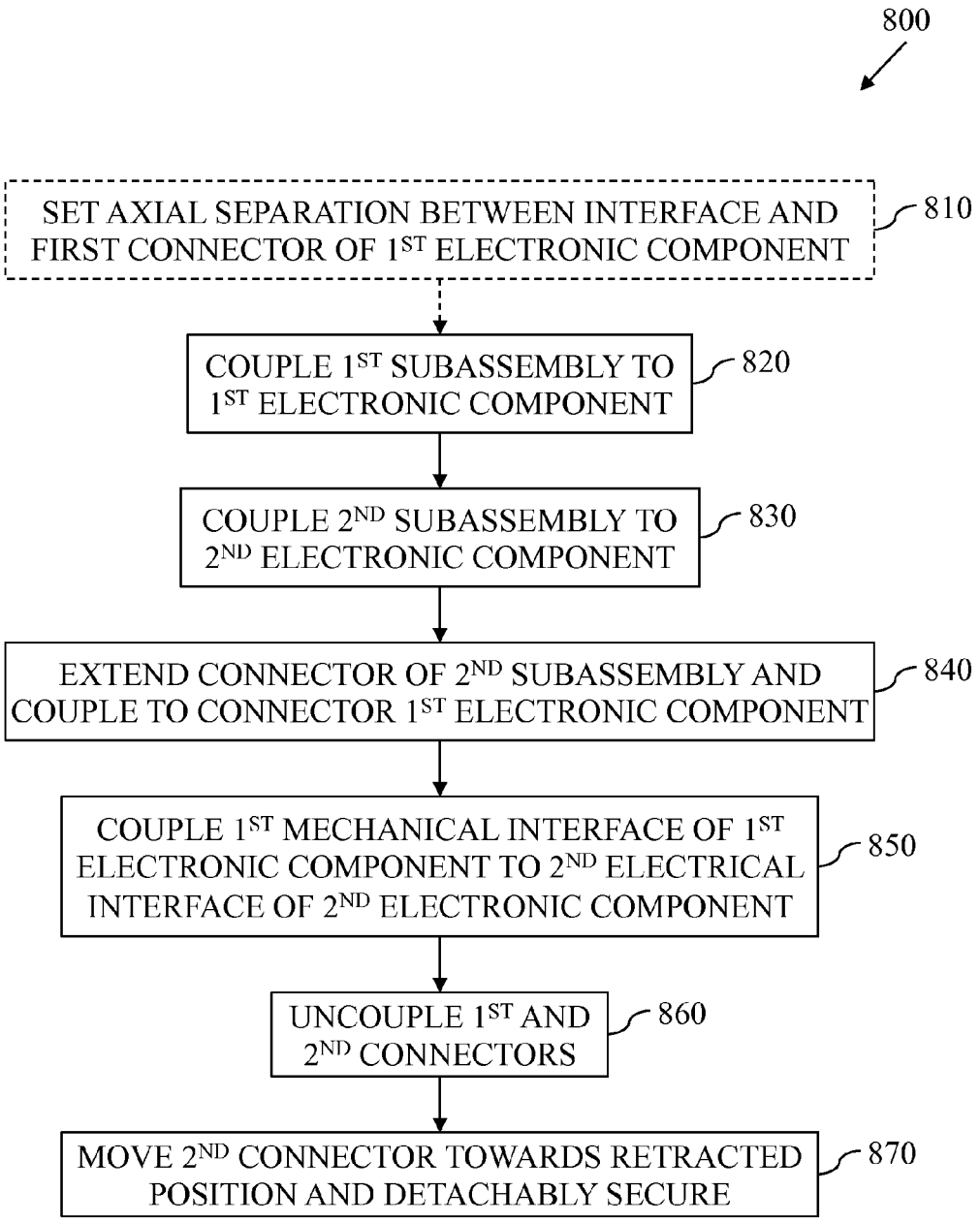
FIG. 8 is a flow-chart diagram of at least a portion of a method according to one or more aspects of the present disclosure.

FIG. 8 is a flow-chart diagram of at least a portion of a method (800) according to one or more aspects of the present disclosure. The method (800) may be performed in the environment depicted in FIG. 1, among others, utilizing apparatus described above, shown in one or more of FIGS. 1-7, and/or otherwise within the scope of the present disclosure.

The example method (800) shown in FIG. 8 includes coupling (820) a first subassembly to a first electronic component. For example, this may entail coupling the connection device 230 to the electronic component 200 shown in FIGS. 4-7. However, prior to such operation, an axial separation between an interface of the first electronic component and a connector of the first electronic component may be set (810). For example, with reference to FIGS. 4-7, this may entail assembling one or more of the spacers 260 between the connector 280 and the interface 235.

A second subassembly may then be coupled (830) to a second electronic component. For example, this may entail coupling the extendable connection device 130 to the electronic component 100 shown in FIGS. 2-7.

A connector of the second subassembly may then be extended and coupled (840) to the connector of the first electronic component. For example, this may entail extending the connector 180 away from the body 150 of the extendable connection device 130 and then coupling the connector 180 to the connector 280 of the connection device 230, as depicted in FIG. 6.

A mechanical interface of the first electronic component may then be coupled (850) to a mechanical interface of the second electronic component. For example, with reference to FIGS. 2-7, this may entail coupling the interface 120 of the electronic component 100 with the interface 220 of the electronic component 200.

The method (800) may further comprise uncoupling (860) the connectors of the first and second electronic components and subsequently moving (870) the connector of the second electronic component towards a retracted position, where the second connector may be detachably secured. For example, with reference to FIGS. 2-7, this may entail uncoupling the mechanical interfaces 120 and 220, moving the electronic components 100 and 200 apart (thus simultaneously extending the conductor 140 and the armored sheath 144 further away from the body 150), and then uncoupling the connectors 180 and 280. The operator and/or the biasing member 190 may then urge the connector 180 back towards the retracted position, which the connector 180 may again detachably engage with the end fitting 155, the body 150, and/or another component or feature of the extendable connection device 130. Thus, the arrangement depicted in FIG. 5 may once again be attained.

In view of the entirety of the disclosure in the description above and in the figures, a person having ordinary skill in the art should readily recognize that the present disclosure introduces an apparatus comprising: a first interface and a first connector disposed at opposing ends of a first body, wherein the first interface is operable to detachably couple with a first downhole tool conveyable within a wellbore extending into a subterranean formation, and wherein a first conductor extends between the first interface and the first connector within the first body; and a second interface and a second connector disposed at opposing ends of a second body, wherein the second interface is operable to detachably couple with a second downhole tool, wherein a second conductor retractable into the second body extends between the second interface and the second connector, and wherein the second connector is operable to extend away from the second body and detachably couple with the first connector.

At least a portion of the second conductor may be armored.

The apparatus may further comprise a biasing member operable to urge the second connector towards a retracted position adjacent the second body.

The second conductor may comprise a coiled portion having an extendable length.

The second connector may detachably couple to the second body when retracted. The detachable coupling of the second connector with the second body may be magnetic.

The apparatus may further comprise a spacer disposed between the first interface and the first connector. The spacer may set a predetermined axial separation between the first interface and the first connector. The spacer may be one of a plurality of spacers collectively disposed between the first interface and the first connector.

The present disclosure also introduces an apparatus comprising: a first interface operable to mechanically and communicably couple with a first downhole electronic component; a first connector communicably connected to the first interface; a second interface extending from a body and operable to mechanically and communicably couple with a second downhole electronic component; a second connector; a conductor extending within the body and communicably connecting the second interface with the second connector, wherein the second connector is extendable away from the body to mechanically and communicably couple with the first connector, and wherein the conductor extends from and retracts into the body in response to relative axial movement of the second connector and the body; and a biasing member urging the second connector towards a retracted position adjacent the body.

The conductor may extend from and retract towards the body in response to relative axial movement of the first and second downhole electronic components when the first and second connectors are coupled.

The apparatus may further comprise the first and second downhole electronic components.

The body may be a second body, the conductor may be a second conductor, and the apparatus may further comprise: a first body extending between the first interface and the first connector; and a first conductor extending within the first body and communicably connecting the first interface with the first connector.

The conductor may comprise an axially extendable coiled portion.

The apparatus may further comprise a downhole tool string conveyable within a wellbore extending into a subterranean formation, wherein the downhole tool string comprises a plurality of downhole electronic components, and wherein the plurality of downhole electronic components includes the first and second downhole electronic components.

The present disclosure also introduces a method comprising: coupling a first interface of a first subassembly to a first component, wherein the first subassembly comprises a first connector; coupling a second interface of a second subassembly to a second component, wherein the second subassembly comprises a body and a second connector extendable from the body, and wherein the second connector remains communicably connected to the second interface by a conductor extendable from and retractable into the body; and extending the second connector away from the body and then coupling the first and second connectors together.

The method may further comprise setting a predetermined axial separation between the first interface and the first connector by positioning at least one spacer between the first interface and the first connector.

Coupling the first and second connectors together may communicably couple the first and second components together.

The first and second components may comprise first and second mechanical interfaces, respectively.

The method may further comprise coupling the first and second mechanical interfaces together after coupling the first and second connectors together.

The method may further comprise: uncoupling the first and second connectors; and detachably securing the second connector adjacent the body. The method may further comprise moving the second connector towards a retracted position adjacent the body after uncoupling the first and second connectors.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same benefits of the example implementations introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

What is claimed is:

1. An apparatus, comprising:

a first interface and a first connector disposed at opposing ends of a first body, wherein the first interface is operable to detachably couple with a first downhole tool conveyable within a wellbore extending into a subterranean formation, and wherein a first conductor extends between the first interface and the first connector within the first body;

a second interface and a second connector disposed at opposing ends of a second body, wherein the second interface is operable to detachably couple with a second downhole tool, wherein a second conductor retractable into the second body extends between the second interface and the second connector, and wherein the second connector is operable to extend away from the second body and detachably couple with the first connector; and a biasing member operable to urge the second connector towards a retracted position adjacent the second body.

2. The apparatus of claim 1 wherein at least a portion of the second conductor is armored.

3. The apparatus of claim 1 wherein the second conductor comprises a coiled portion having an extendable length.

4. The apparatus of claim 1 wherein the second connector detachably couples to the second body when retracted.

5. The apparatus of claim 4 wherein the detachable coupling of the second connector with the second body is magnetic.

6. The apparatus of claim 1 further comprising a spacer disposed between the first interface and the first connector.

7. The apparatus of claim 6 wherein the spacer sets a predetermined axial separation between the first interface and the first connector.

8. The apparatus of claim 7 wherein the spacer is one of a plurality of spacers collectively disposed between the first interface and the first connector.

9. An apparatus, comprising:

a first interface operable to mechanically and communicably couple with a first downhole electronic component;

a first connector communicably connected to the first interface;

a second interface extending from a body and operable to mechanically and communicably couple with a second downhole electronic component;

a second connector;

a conductor extending within the body and communicably connecting the second interface with the second connector, wherein the second connector is extendable away from the body to mechanically and communicably couple with the first connector, and wherein the conductor extends from and retracts into the body in response to relative axial movement of the second connector and the body; and a biasing member urging the second connector towards a retracted position adjacent the body.

10. The apparatus of claim 9 wherein the conductor extends from and retracts towards the body in response to relative axial movement of the first and second downhole electronic components when the first and second connectors are coupled.

11. The apparatus of claim 9 further comprising the first and second downhole electronic components.

12. The apparatus of claim 9 wherein the body is a second body, the conductor is a second conductor, and the apparatus further comprises:

a first body extending between the first interface and the first connector; and a first conductor extending within the first body and communicably connecting the first interface with the first connector.

13. The apparatus of claim 9 wherein the conductor comprises an axially extendable coiled portion.

14. The apparatus of claim 9 further comprising a downhole tool string conveyable within a wellbore extending into a subterranean formation, wherein the downhole tool string comprises a plurality of downhole electronic components, and wherein the plurality of downhole electronic components includes the first and second downhole electronic components.

15. An apparatus, comprising:

a first interface and a first connector disposed at opposing ends of a first body, wherein the first interface is operable to detachably couple with a first downhole tool conveyable within a wellbore extending into a subterranean formation, and wherein a first conductor extends between the first interface and the first connector within the first body;

a second interface and a second connector disposed at opposing ends of a second body, wherein the second interface is operable to detachably couple with a second downhole tool, wherein a second conductor retractable into the second body extends between the second interface and the second connector, and wherein the second connector is operable to extend away from the second body and detachably couple with the first connector; and wherein the second connector detachably couples to the second body when retracted.

16. The apparatus of claim 15 wherein the detachable coupling of the second connector with the second body is magnetic.

* * * * *